United States Patent [19]

Wirth et al.

[11] Patent Number: 4,842,653

[45] Date of Patent: Jun. 27, 1989

[54] PROCESS FOR IMPROVING THE STATIC AND DYNAMIC MECHANICAL PROPERTIES OF ($\alpha+\beta$)-TITANIUM ALLOYS

[75] Inventors: Günter Wirth, Rosrath; Karl-Josef Grundhoff, Troisdorf; Hartmut Schurmann, Seelscheid, all of Fed. Rep. of Germany

[73] Assignee: Deutsche Forschungs-und Versuchsanstalt fur luft-und Raumfahrt e.V., Koln, Fed. Rep. of Germany

[21] Appl. No.: 67,864

[22] Filed: Jun. 30, 1987

[30] Foreign Application Priority Data

Jul. 3, 1986 [DE] Fed. Rep. of Germany ..... 3622433

[51] Int. Cl.[4] ..... C22F 1/18

[52] U.S. Cl. ..... 148/12.7 B; 148/11.5 F; 148/11.5 P

[58] Field of Search ..... 148/12.7 B, 11.5 F, 148/11.5 P

[56] References Cited

U.S. PATENT DOCUMENTS

| | | | |
|---|---|---|---|
| 3,489,617 | 1/1970 | Wuerfel | 148/12.7 B |
| 3,575,736 | 4/1971 | Fitzpatrick et al. | 148/12.7 B |
| 3,794,528 | 2/1974 | Rosales et al. | 148/12.7 B |
| 3,901,743 | 8/1975 | Sprague et al. | 148/12.7 B |
| 4,053,330 | 10/1977 | Henricks et al. | 148/12.7 B |
| 4,098,623 | 7/1978 | Ibaraki et al. | 148/11.5 F |
| 4,482,398 | 11/1984 | Eylon et al. | 148/11.5 F |
| 4,581,077 | 4/1986 | Sakuyama et al. | 148/12.7 B |
| 4,601,874 | 7/1986 | Marty et al. | 148/11.5 P |
| 4,675,055 | 6/1987 | Ouchi et al. | 148/11.5 F |

*Primary Examiner*—Upendra Roy

*Attorney, Agent, or Firm*—Wegner & Bretschneider

[57] ABSTRACT

The process relates to the improvement of the static and dynamic mechanical properties of ($\alpha+\beta$) titanium alloys by thermomechanical treatment, wherein the alloys produced by melting and forging and/or hot isostatic pressing of powders are deformed by more than 60% with simultaneous strain-hardening at a temperature just above the recrystallization temperature of the relevant alloys in one or more steps, with structure stress-relief heatings being performed without complete recrystallization between these individual steps, the shaped part is then tempered for 2 to 4 min near the transus of the alloy, quenched and then aged at temperatures in the range of from 400° to 600° C.

11 Claims, 8 Drawing Sheets

1000 x

Ti6Al4V
64 % deformed at 850 °C 1000 x

Ti6Al4V
fine (α + β) structure
975 °C/3 min/water
64 % deformed at 850 °C 1000 x Ti6Al4V
fine (α + β) structure
975 °C/3 min/water + 500 °C/2 h
64 % deformed at 850 °C TEM picture
fine (α + β) structure
975 °C/3 min/water + 500 °C/2 h
64 % deformed at 850 °C

PROCESS FOR IMPROVING THE STATIC AND DYNAMIC MECHANICAL PROPERTIES OF ($\alpha+\beta$)-TITANIUM ALLOYS The invention relates to aprocess for improving the static and dynamic mechanical properties of ($\alpha+\beta$)-titanium alloys by thermomechanical treatment.

BACKGROUND OF THE INVENTION

It is known that the mechanical properties of titanium can already be improved by means of alloying additions. By the addition of certain alloying elements the transformation temperature of titanium from the $\alpha$ into the $\beta$ phase can be raised or lowered, i.e., a distinction is made between alloying additions that stabilize either the $\alpha$ or the $\beta$ phase. For example, aluminum is among the $\alpha$-stabilizing alloying elements and is dissolved as a substitutional mixed crystal, while vandium and molybdenum, among others, can be cited as prime examples of $\beta$-stabilizing alloying elements. Zirconium and tin dissolve well in both phases.

The different phases present at room temperature after annealing are subdivided into $\alpha$-titanium alloys, $\beta$-titanium alloys and ($\alpha+\beta$)-titanium alloys. These alloys are described by, for example, A. D. McQuillan and M. K. McQuillan in "TITANIUM", London, Butterwords Scientific Publications, 1956.

The present invention relates especially to the ($\alpha+\beta$) titanium alloys. Typical examples of these alloys are the alloys listed in Table I below, for which the strength data at room temperature are also indicated.

TABLE I

| ($\alpha+\beta$) alloy | Ultimate tensile strength RM [MPa] | 0.2%-offset yield strength $R_{P0.2\%}$ [MPa] | Elongation after fracture EL [%] | Reduction of area RA [%] |
|---|---|---|---|---|
| Ti4Al4Mo2Sn 0.5Si | 1115 | 980 | 9 | 20 |
| Ti6Al4V | 900 | 830 | 10 | 20 |
| Ti6Al6V2Sn Fe Cu | 1035 | 965 | 10 | 15 |
| Ti6Al4Zr2Mo2Sn | 900 | 830 | 10 | 20 |
| Ti7Al4Mo | 965 | 900 | 10 | 15 |

In recent years there has been no lack of attempts to improve the static and dynamic mechanical properties of these ($\alpha+\beta$) titanium alloys by subjecting them to special treatments, i.e., thermomechanical treatments, wherein the materials are first usually hot-worked, since their elongation before reduction of area is small. By means of solution annealing and stabilization, it is then possible to achieve better material properties such as, for example, increased thermal stability and improved creep behavior.

Numerous publications concerning improvements of the mechanical properties of titanium alloys have recently appeared in connection with the International Conference on Titanium of Sept. 10–14, 1984 in Munich in Volume 1 of the Proceedings. By way of example, reference is made here to the papers in that Volume 1 on page 179 ff., page 267 ff., page 327 ff. and page 339 ff. The mechanical properties of highly advanced PM titanium shaped parts are also reported by J. P. Herteman et al. in "Powder Metallurgy International" Vol. 17, No. 3, 1985, pages 116 to 118, wherein the authors have observed that the mechanical properties of a material processed by hot isostatic pressing can be improved by the use of purer oxide-free powder and the adjustment of a suitable structure to such an extent that this so-called HIP material, in its strength values and susceptibility to damage, can be favorably compared with forged materials or is even slightly superior to them. Nonetheless, however, that paper reveals that the values for the ultimate tensile strength (RM) and yield strength (0.2%-offset yield strength $R_{P0.2\%}$) still cannot be raised above 1100 MPa, while the elongation (breaking elongation EL) does not rise above 17% and the reduction of area (RA) reaches hardly more than 40%.

SUMMARY OF THE INVENTION

Since, besides the chemical industry as the largest consumer, it is still the aerospace industry that is and must be especially interested in titanium alloys having improved mechanical properties, the problem addressed by the present invention was to make available a process for improving the static and dynamic mechanical properties of ($\alpha+\beta$)-titanium alloys by thermomechanical treatment and thus ($\alpha+\beta$)-titanium alloys that exhibit ultimate tensile strength which, in addition, are also able to withstand a number of load cycles to fracture which is greater than those of ($\alpha+\beta$) titanium alloys of comparable composition obtained by processes in common use heretofore.

The working by more than 60% required initially according to the invention for the ($\alpha+\beta$) titanium alloys produced by melting and forging and/or hot isostatic pressing, some examples of which were indicated above, can be suitably accomplished by means of forging, pressing, swaging, rolling or drawing. Of the cited alloys, the alloy Ti6Al4V has proved especially suitable for the process according to the invention, but the alloys Ti6Al6V2Sn, Ti7Al4Mo and Ti6Al2Sn4Zr2Mo can also be successfully thermomechanically treated.

DESCRIPTION OF THE INVENTION

Figure 5A:
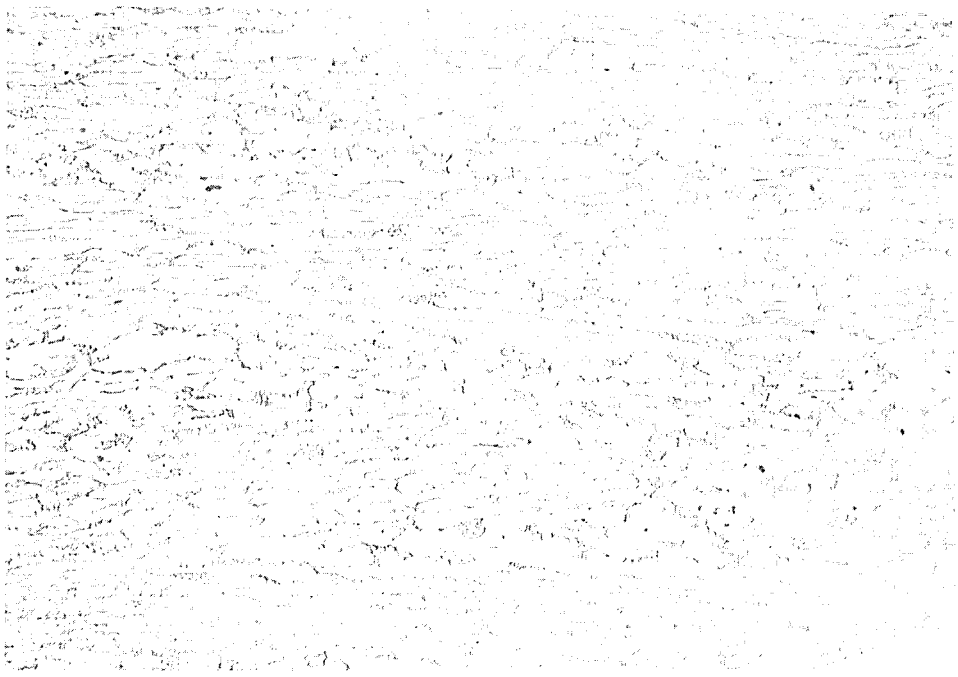
FIGS. 5*a*–5*b* and 6*a*–6*b* illustrate microstructure of thermomechanically treated alloys.

According to the invention, the structure of the alloys could be stress-relieved by heating between the individual deformation steps, making certain that this microstructure is not completely recrystallized. For this reason, lenghty intermediate annealings are to be avoided in any case. Illustrated by way of example in FIG. 5a is the structure of the high-strength alloy Ti-6Al4V after swaging at 850° C. at 1000-times magnification.

The shaped part with the desired final dimensions is then temperred, i.e., annealed for 2 to 4 min at the transus. It is known that the transus, i.e., the temperature of allotropic transformation of, for example, pure titanium, lies at 885° C. This means that the hexagonal crystal lattice of $\alpha$-titanium that exists at temperatures below 885° C. goes over at higher temperature into the cubic body-centered lattice of $\beta$-titanium.

Figure 5B:
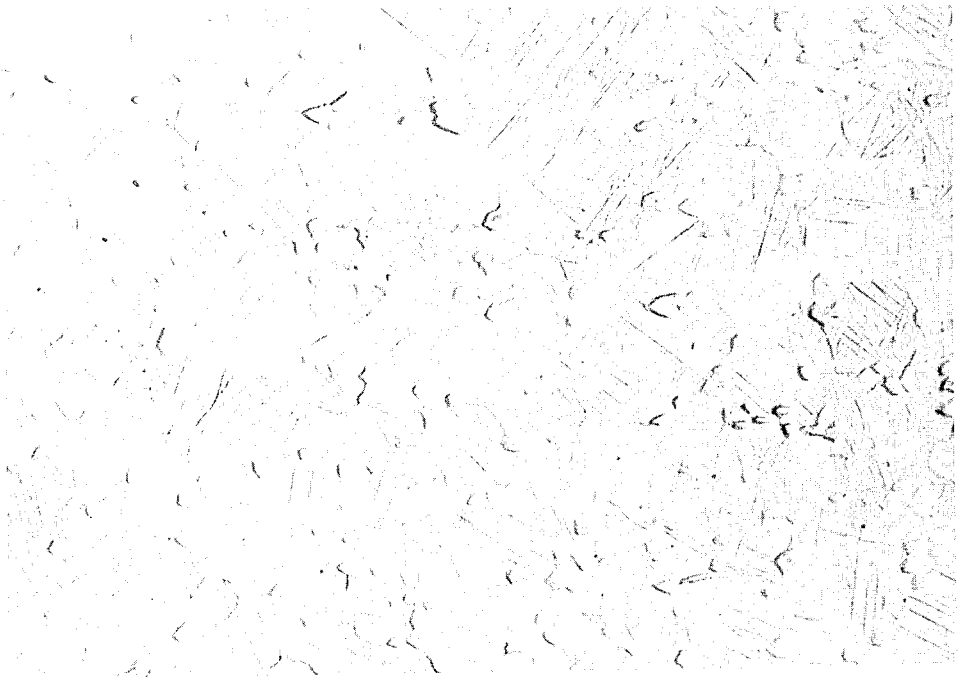

For the alloy Ti6Al4V the transus lies at 975° C., depending on oxygen content. The alloys are quenched after the annealing, suitable means for the quenching being familiar to a person skilled in the art. Preferably, however, the quenching is done with water, with oil or with both means. The structure of the alloy already mentioned in connection with FIG. 5*a* is illustrated in FIG. 5*b*, again at 1000-times magnification. This figure shows the interstitial insertion of globular, relatively large $\alpha$ particles ($\mu$m range) in the $(\alpha+\beta)$ structure, while in the $(\alpha+\beta)$ region one can observe extremely small precipitates of $\alpha$ lamellae which are interstitially inserted in the $\beta$ structure.

Figure 6A:
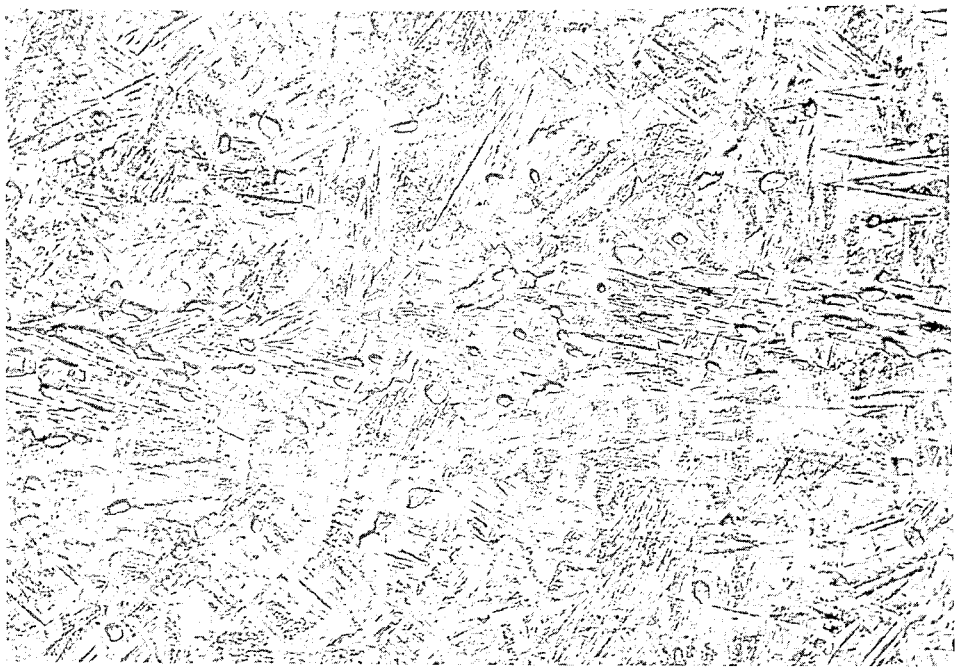
Figure 6B:
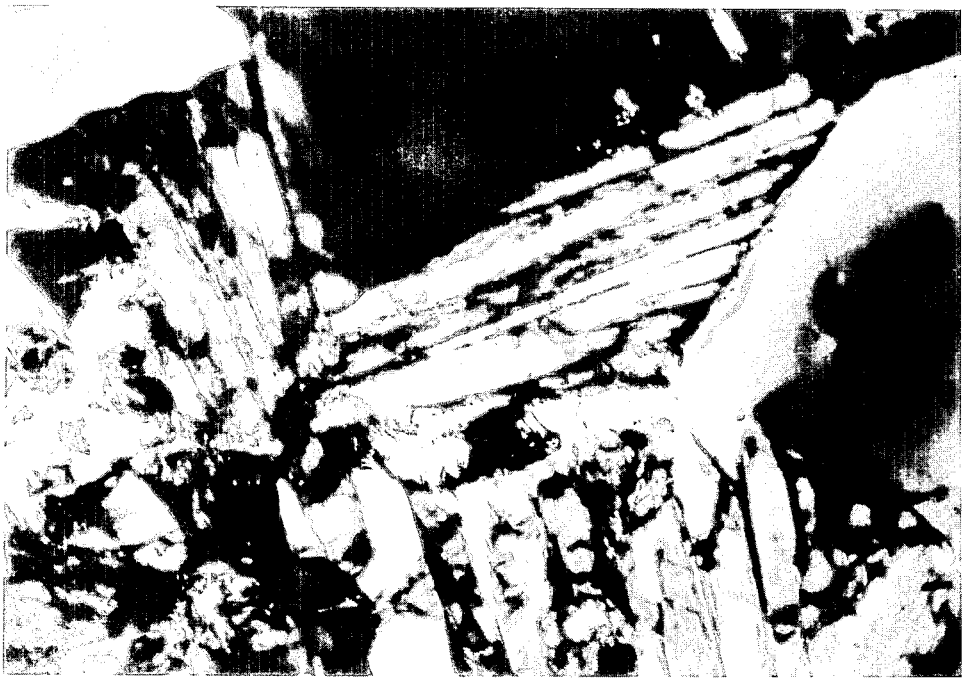

To achieve stabilization of this structure, the quenched shaped parts are then aged at temperatures in the range of from 400° C. to 600° C., preferably for 2 h at 400° C. to 500° C. This coarsens the $(\alpha+\beta)$ precipitates without changing the large $\alpha$ grains. This is shown by the structure reproduced in FIG. 6*a* for the alloy Ti6Al4V chosen as an example. As can be seen in the TEM picture (FIG. 6*b*), the $\alpha$ particles exhibit dislocations and low-angle grain boundaries, i.e., these $\alpha$ particles are polygonized and not recrystallized.

As is knonw to a person skilled in the art, alloying elements in titanium alloys can influence the transus. Al und O extend the $\alpha$ region of the alloys to higher temperatures. The elements V, Mo, Mn and Cr extend the $\beta$ region of the alloys, i.e., the temperature of the transus falls. For the alloy Ti6Al4V, the transus of pure titanium is shifted to a higher temperature, Zn and Sn are neutral elements in this respect.

For the $(\alpha+\beta)$ titanium alloys used in practice, i.e., especially Ti6A14V, but also the alloys Ti6Al6V2Sn, Ti7Al4Mo and Ti6Al2Sn4Zr2Mo, an $(\alpha+\beta)$ structure is present at room temperature. The structure can be changed by working and annealing, and various mechanical properties can be adjusted in this manner. The material is first to be greatly deformed, i.e., by >60%, at about 50° C. above the recrystallization temperature of ca. 800° C., i.e., at 850° C., so that is is intensively plasticaly worked and thereby strainhardened. By solution annealing below 950° C. and tempering for 2 h at 500° C., a globular $(\alpha+\beta)$ structure is adjusted. Upon allealing at between 950° C. and 975° C. and tempering at 500° C., a fine $(\alpha+\beta)$ structure is adjusted, namely, very fine equiaxed primary $\alpha$ embedded in lamellar $(\alpha+\beta)$ matrix structure, with outstanding mechanical properties. In contrast, upon annealing above 975° C. and tempering, a lamellar structure is formed whose ductility is sharply decreased. The fine $(\alpha+\beta)$ structure is a prerequisite for an increase of the ultimate tensile strength and 0.2%-offset yield strength with a simultaneous increase of the elongation and of the reduction of area. In addition, the fatigue strength for a large number of load cycles is doubled in comparison to conventional materials.

Figure 3:
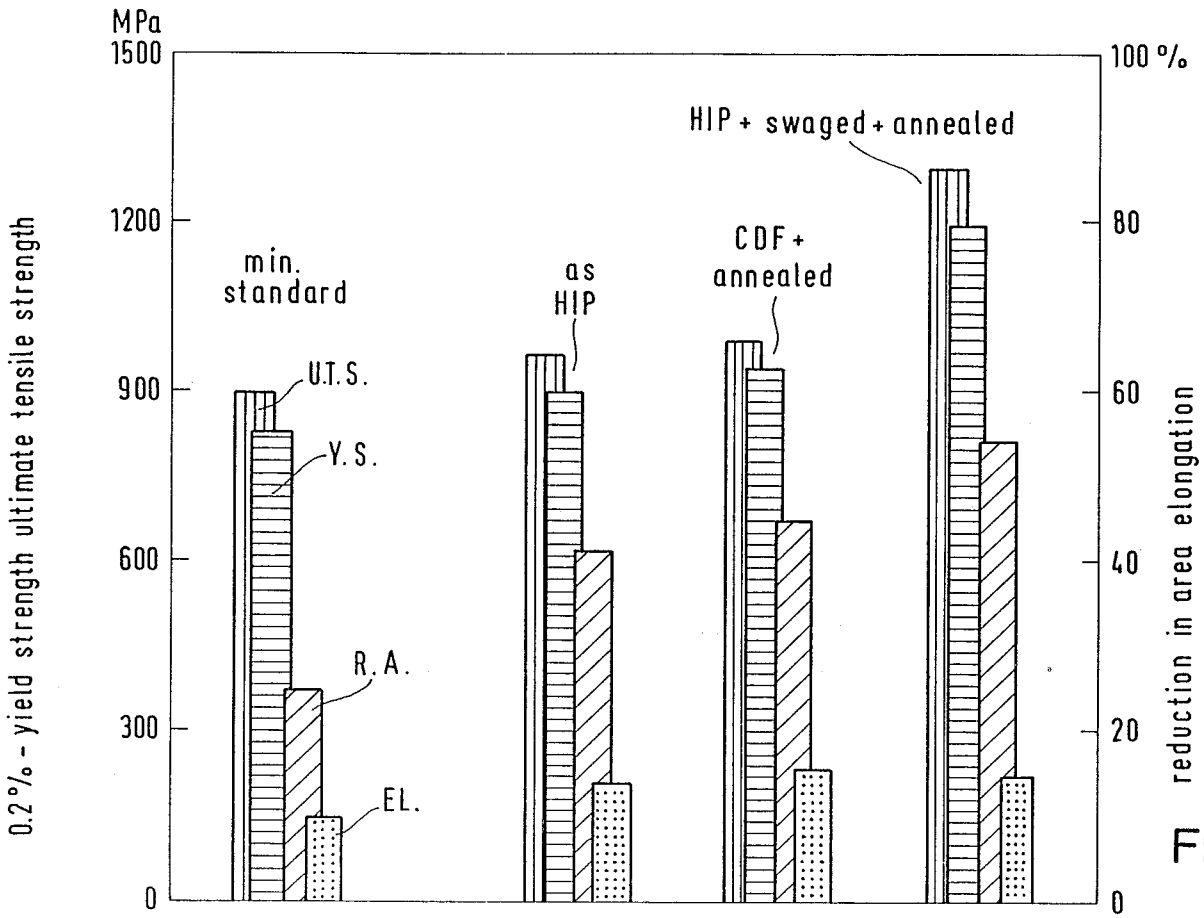

The outstanding mechanical properties of the $(\alpha+\beta)$ titanium alloys produced according to the invention, clearly improved over the comparision alloys known heretofore, are illustrated in the following Table II and in the appended diagram (FIG. 3). The values of ultimate tensile strength, 0.2%-offset yield strength, elongation and reduction of area are far above the minimum values specified in DIN Standard No. 17 851. Table II also indicates the values deterined for the modulus of elasticity. Although it is true that the alloy Ti6A14V that is only HIP-deformed also meets the DIN Standard, the material produced according to the invention far surpasses it in all values, it being especially surprising that along with the increased strength the ductility of the material is also considerably increased, namely, by about 30%.

Figure 4:
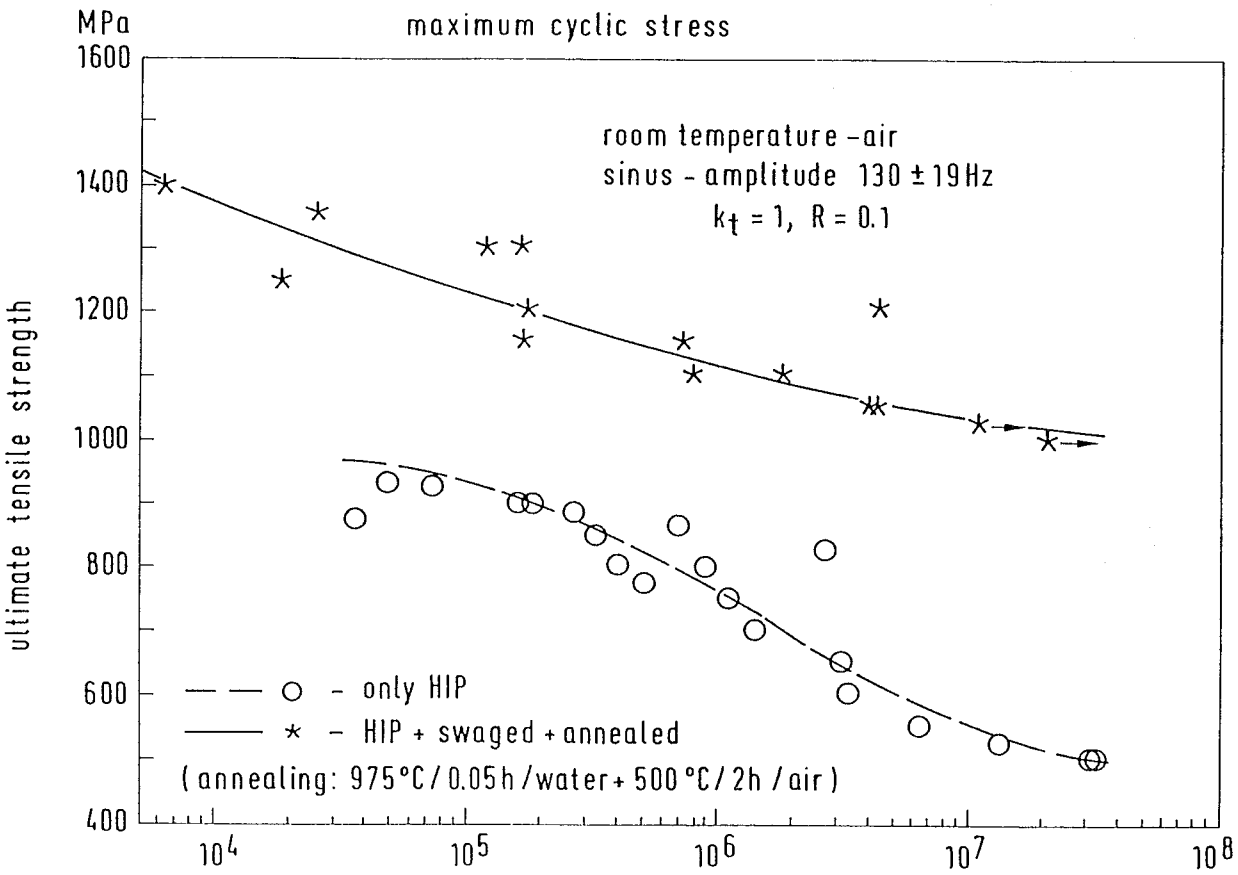

The fatigue strength of the alloy was measured in the AmslerPulser under the conditions R=0.1, $k_t=1$ and the frequency 130±19 Hz. The upper Woehler curve shown in the diagram (FIG. 4) for the material produced according to the invention exhibits, throughout the entire frequency range and for a number of load cycles up to $10^7$, sharply improved cyclic fatigue strengths in comparison to the materials produced according to the processes commonly used heretofore (lower Woehler curve). The properties were improved by 40% in the ultimate tensile strength and by 100% in the fatigue strength.

In one example of application, screws 8 mm in diameter were produced and tested for their cyclic fatigue strength. Whereas conventional material was able to endure a maximum of 30,000 periodic stress changes until fracture, after application of the thermomechanical treatment according to the invention the number of periodic stress changes until fracture was 360,000, i.e., greater by a factor of 12, with the same load.

The transus increases with higher oxygen content. If the oxygen content is higher, the annealing at 975° C. is below the transus. But if the oxygen content is lower, the annealing at 975° C. is above the transus.

On the basis of the described improvement of the static and dynamic mechanical properties of the materials produced according to the invention, it is obvious that by its use the range of application of high-strength $(\alpha+\beta)$ alloys can be considerably extended, both for static and dynamic loads, which is of great significance especially for the aerospace industry.

Figure 1:
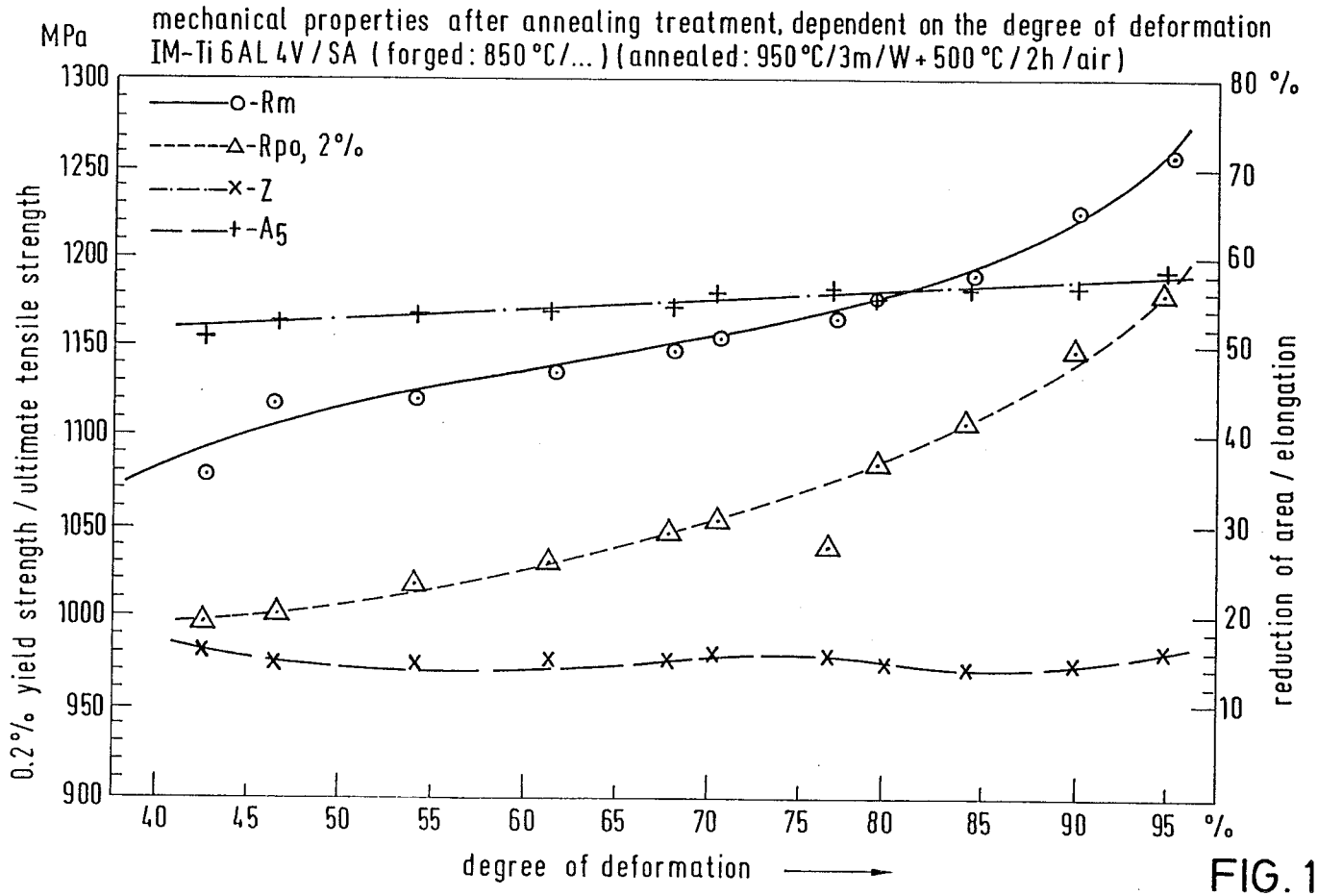
FIGS. 1 through 4 show static and dynamic properties of alloys by thermomechanical treatments.
Figure 2:
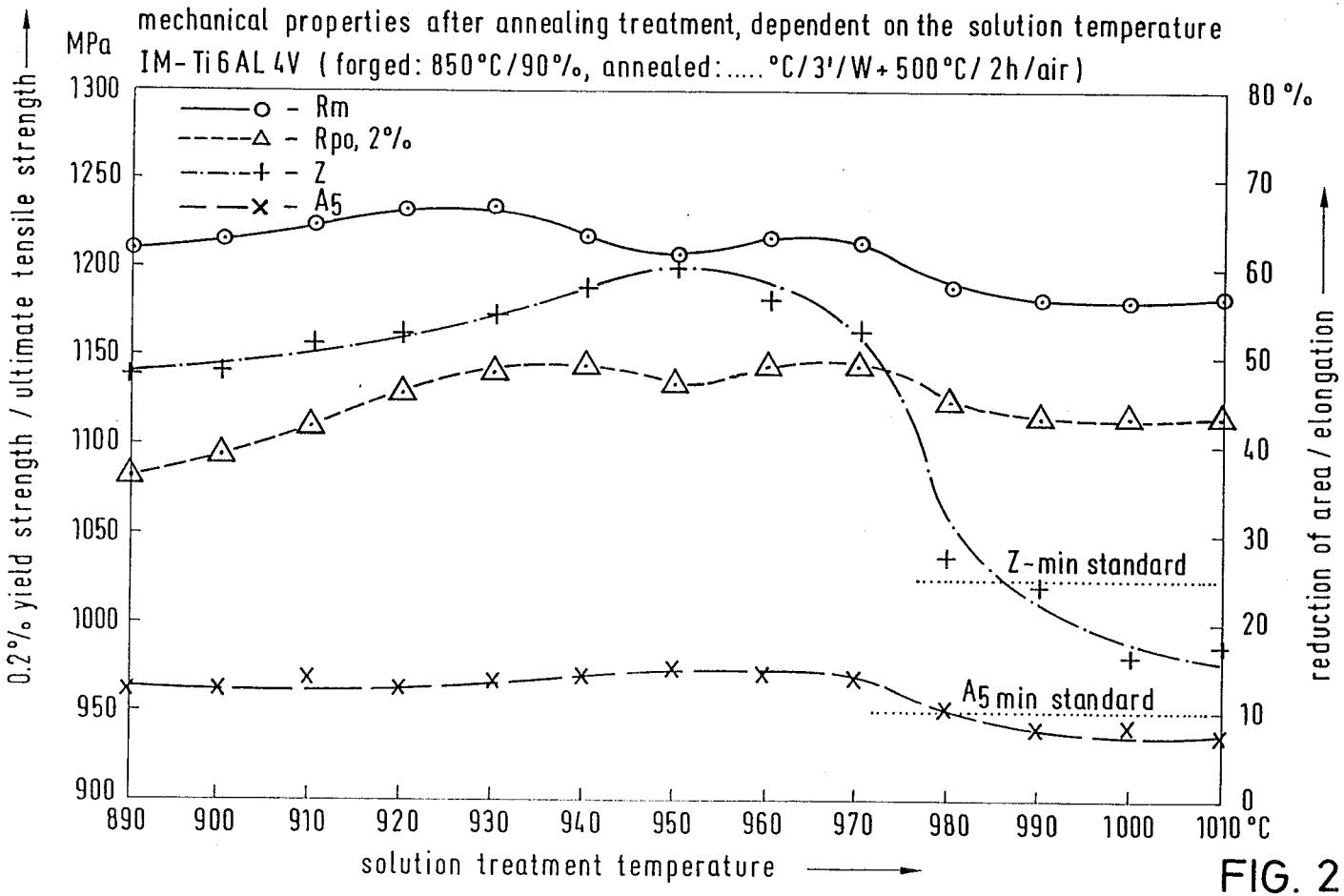

The mechanical properties of the alloy Ti6Al4V after the annealing treatment are illustrated by curves in FIGS. 1 and 2, in one as a function of the degree of deformation (FIG. 1) and in the other as a function of the solution temperature (FIG. 2).

TABLE II

| | Static mechanical properties | | | | |
|---|---|---|---|---|---|
| | Ultimate tensile strength RM [MPa] | 0.2%-offset yield strength $R_{P0.2\%}$ [MPa] | Elongation after fracture EL [%] | Reduction of area RA [%] | Modulus of elasticity E [GPa] |
| DIN Standard 17 851 | 910 | 840 | 10 | 25 | 110 |
| HIP densification 930° C. 2.5 h 1.94 kbar | 967.3 | 900.0 | 14.5 | 41.4 | 128 |
| HIP densification, extruded 900° C., swaged 63.5% at 850° C., heat-treated at 975° C./3 min/ water quenching; 500° C. 2 h air cooling | 1298.0 | 1203.4 | 15.1 | 54.3 | 116.1 |

What is claimed is:

1. Process for improving the static and dynamic mechanical properties of $(\alpha+\beta)$-titanium alloys by thermomechanical treatment comprising the steps of: (a)

deforming an $(\alpha+\beta)$-titanium alloy by more than 60% with simultaneous strain-hardening at a temperature just above the recrystallization temperature of the alloy in one or more deforming steps, (b) structure stress-relief heating the alloy without complete recrystallization following each of the one or more deforming steps, (c) tempering the alloy after all deforming and heating steps for about 2 to 4 minutes near the transus of the alloy, (d) quenching the alloy after tempering, and (e) aging the alloy at temperatures of about 400°-600° C. after quenching.

2. Process in accordance with claim 1, characterized in that the deforming step is performed by forging, pressing, hammering, rolling or drawing.

3. Process in accordance with claim 1, characterized in that the quenching step is performed with water, oil, or mixture thereof.

4. Process in accordance with claim 1, characterized in that the tempering step is performed for 3 minutes at temperatures between about 950° C. and 980° C., and the aging step is performed for 2 hours at 450°-550° C.

5. Process in accordance with claim 1, characterized in that the alloy is in $(\alpha+\beta)$-titanium multicomponent alloy based on Ti4AlX or Ti6AlX, where X signifies one or more alloying elements selected from the group consisting of vandium, molybdenum, zirconium, tin, iron, copper and silicon.

6. Process in accordance with claim 1, characterized in that the alloy is Ti6Al4V, the deforming step is by 90% performed by hammering at 850° C., the tempering step is performed for 3 minutes at 975° C., the quenching step is performed with water, and the aging step is performed for 2 hours at 500° C. in air.

7. Process in accordance with claim 2, characterized in that the tempering step is performed for 3 minutes at temperature between about 950° C. and 980° C., and the aging step is performed for 2 hours at 450° C.-500° C.

8. Process in accordance with claim 4, characterized in that the alloy is in $(\alpha+\beta)$-titanium multicomponent alloy based on Ti4AlX or Ti6AlX, where X signifies one or more alloying elements selected from the group consisting of vandium, molybdenum, zirconium, tin, iron, copper and silicon.

9. Process in accordance with claim 4, characterized in that the alloy is Ti6Al4V, the deforming step is by 90% performed by hammering at 850° C., the tempering step is performed for 3 minutes at 975° C., the quenching step is performed with water, and the aging step is performed for 2 hours at 500° C. in air.

10. Process in accordance with claim 7, characterized in that the alloy is in $(\alpha+\beta)$-titanium multicomponent alloy based on Ti4AlX or Ti6AlX, where X signifies one or more alloying elements selected from the group consisting of vandium, molybdenum, zirconium, tin, iron, copper and silicon.

11. Process in accordance with claim 7, characterized in that the alloy is Ti6Al4V, the deforming step is by 90% performed by hammering at 850° C., the tempering step is performed for 3 minutes at 975° C., the quenching step is performed with water, and the aging step is performed for 2 hours at 500° C. in air.

* * * * *